United States Patent [19]

Kobayashi

[11] Patent Number: 4,826,160

[45] Date of Patent: May 2, 1989

[54] ACTION TOY GAME APPARATUS

[75] Inventor: Toshio Kobayashi, Chiba, Japan

[73] Assignee: Ashai Corporation, Tokyo, Japan

[21] Appl. No.: 129,824

[22] Filed: Dec. 7, 1987

[30] Foreign Application Priority Data

Dec. 6, 1986 [JP] Japan ..... 61-188012[U]

[51] Int. Cl.[4] ..... A63F 9/00

[52] U.S. Cl. ..... 273/1 GE; 273/1 GG

[58] Field of Search ..... 273/1 GG, 1 GE, 1 GC, 273/1 GF

[56] References Cited

U.S. PATENT DOCUMENTS

| | | | |
|---|---|---|---|
| 4,229,003 | 10/1980 | Shimizu | 273/1 GG X |
| 4,244,568 | 1/1981 | Ferris et al. | 273/1 GE |
| 4,306,717 | 12/1981 | Todokoro | 273/1 GG X |
| 4,366,957 | 1/1983 | Aldcroft et al. | 273/1 GF |

*Primary Examiner*—Paul E. Shapiro

*Attorney, Agent, or Firm*—Salter & Michaelson

[57] ABSTRACT

An action toy game apparatus includes a base, a timer in the base, a plurality of game elements, a game element support assembly, a game element retrieving mechanism and an ejection mechanism. The game element support assembly is receivable on the base for releasably supporting the game elements, and the timer is actuatable for set periods of time for rotating the game element support assembly so that the game elements travel in a substantially circular path which is spaced upwardly from the base. The retrieving mechanism is preferably embodied as an amusing character figure and it is operable for retrieving the game elements from the support assembly, and the ejection mechanism is operative for ejecting the support assembly and any of the game elements thereon upon the expiration of the set period of time as determined by the timer.

3 Claims, 4 Drawing Sheets

ACTION TOY GAME APPARATUS

BACKGROUND AND SUMMARY OF THE INVENTION

The instant invention relates to action toys and more particularly to an action toy which is operative for playing an amusing game wherein a game player must perform certain feats within a set period of time in order to achieve a game score.

It has been found that games of the general type which require game players to perform certain manipulations within set periods of time in order to achieve game scores often have significant degrees of play value. Further, it has been found that games of this type which incorporate interesting and amusing game apparatus which must be skillfully manipulated in order to achieve game scores ave even greater levels of appeal. Still further, it has been found that games of this general type which are adapted for use by children can be of significant value in aiding in the development of both hand-to-eye coordination and manual dexterity.

The instant invention provides an amusement game apparatus which can be effectively adapted for use by children and which is operative for playing an amusing and interesting game of the general type wherein a game player must perform certain manipulations within a set period of time in order to achieve a game score. More specifically, the action toy game apparatus of the instant invention comprises a base, a timer in the base which is actuatable for a set period of time, a plurality of game elements, and a game element support assembly for releasably supporting the game elements in upwardly spaced relation to the base. The game element support assembly is mounted on the base, and it communicates with the timer for rotating the game element support assembly when the timer is in an actuated condition. Further, the game element support assembly is adapted for releasably supporting the game elements so that they move in a substantially circular path which is spaced upwardly from the base when the support assembly is rotated by the timer. The apparatus further includes a retrieving mechanism mounted on the base which is manually actuatable for individually retrieving the game elements from the support assembly as the support assembly is rotated. The retrieving mechanism preferably comprises a depressible member and a retrieving member, and the depressible member is preferably manually depressible for moving the retrieving member upwardly to retrieve the game elements from the support assembly. The support assembly preferably comprises a pedestal portion which is mounted on the base so that it extends upwardly therefrom and an upper support portion which is mounted on the pedestal portion in upwardly spaced relation to the base. The support assembly is preferably adapted so that it is ejectable from the base, and the apparatus preferably further comprises an ejection mechanism for ejecting the support assembly and any of the game elements thereon from the base upon the expiration of the set period of time as determined by the timer. The retrieving member is preferably formed in the configuration of an amusing character figure, and it includes an upper head portion and a lower jaw portion which cooperate to define a mouth of the character figure. The lower jaw portion is preferably pivotably mounted on the upper head portion for moving the mouth between open and closed positions thereof in order to capture the game elements therein so that they can be retrieved from the support assembly. Further, the retrieving mechanism is preferably operable for automatically moving the mouth of the character figure to the closed position thereof when the retrieving member is moved upwardly in order to enable the retrieving member to be effectively utilized for individually capturing and retrieving the game elements from the support assembly.

For use and operation of the game apparatus of the instant invention, a plurality of the game elements are assembled on the support assembly, the support assembly is assembled on the base, and the timer is moved to a wound position wherein it is operative for rotating the support assembly during a set period of time. Once the timer has been actuated, the support assembly is rotated on the base so that the game elements are moved in a substantially circular path above the base, and accordingly the retrieving mechanism can then be manipulated in order to individually retrieve the game elements from the support assembly. Specifically, the retrieving mechanism can be manipulated by depressing the depressible member so that the retrieving member is moved upwardly in order to individually capture the game elements in the mouth of the character figure embodied in the retrieving member. In this connection, the retrieving mechanism is adapted so that as the depressible member is operated to move the retrieving member upwardly, the mouth of the character figure embodied in the retrieving member can be automatically moved to a closed position in order to effectively capture the game elements in the mouth of the character figure during the set period of time as determined by the timer. However, when the timer reaches the fully unwound or deactuated position thereof, the ejection mechanism is operative for ejecting the support assembly and any of the game elements retaining thereon from the base so that the game elements can no longer be retrieved in the mouth of the character figure. As a result, in order to achieve a game score, a game player must quickly and effectively manipulate the retrieving mechanism during the set period of time as determined by the timer in order to capture as many of the game elements as possible in the mouth of the character figure during the set period of time.

Accordingly, it is a primary object of the instant invention to provide an effective and amusing game apparatus wherein a game player must perform certain manipulations within a set period of time in order to achieve a game score.

Another object of the instant invention is to provide an amusing action toy game apparatus including an amusing character figure which is actuatable for retrieving game elements during a set period of time as the game elements are rotated in a substantially circular path.

An even further object of the instant invention is to provide an action toy game apparatus which is adapted for use by children and operative in connection with an amusing game wherein game elements must be captured in the mouth of a character figure within a set period of time in order to achieve a game score.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
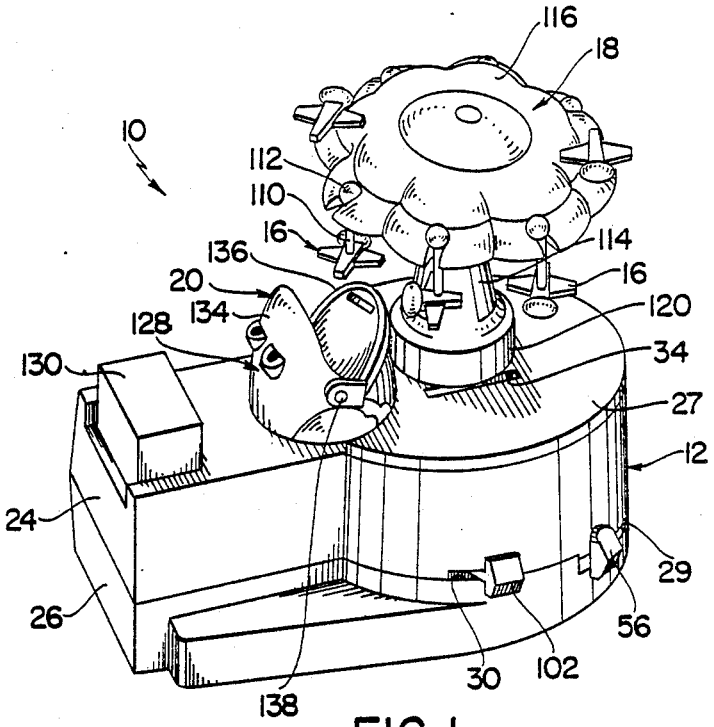
FIG. 1 is a perspective view of the action toy game apparatus of the instant invention.
Figure 2:
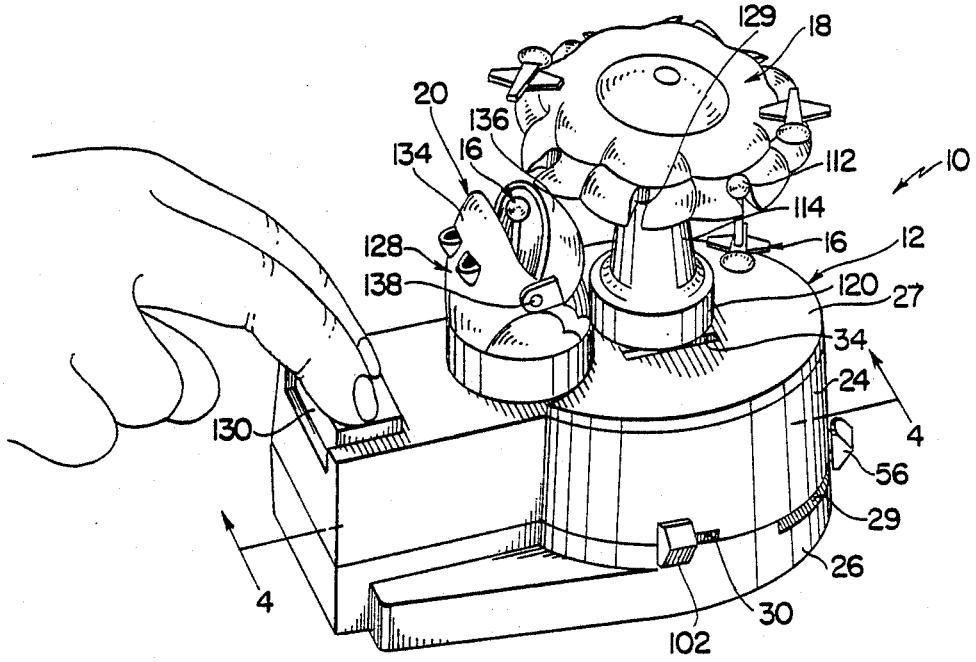
FIG. 2 is a similar view illustrating the operation of the retrieving mechanism of the apparatus for retrieving a game element.

Referring now to the drawings, the action toy game apparatus of the instant invention is illustrated and generally indicated at 10 in FIGS. 1 through 5. The apparatus 10 comprises a base generally indicated at 12, a timer generally indicated at 14, a plurality of game elements 16, a game element support assembly generally indicated at 18, a game element retrieving mechanism generally indicated at 20, and an ejection mechanism generally indicated at 22. The timer 14 is mounted in the base 12, and it is actuatable for set periods of time, and the support assembly 18 is adapted to be releasably supported on the base 12 so that it is operative for supporting the game elements 16 in upwardly spaced relation to the base 12. In this regard, the support assembly 18 is adapted so that when it is supported on the base 12 in this manner, it communicates with the timer 14 for rotating the support assembly 18 so that the game elements 16 travel in a substantially circular path which is spaced upwardly from the base 12 when the timer 14 is in an actuated condition. The retrieving mechanism 20 is manually operable for individually retrieving the game elements 16 from the support assembly 18 as they travel in the circular path above the base 12, and the ejection mechanism 22 is operative for automatically ejecting the support assembly 18 and any of the game elements 16 remaining thereon upon the expiration of the set period of time as determined by the timer 14. Accordingly, the apparatus 10 is adapted to be utilized in an interesting and amusing game wherein a game player must retrieve the game elements 16 from the support assembly 18 utilizing the retrieving mechanism 20 during a set period of time as determined by the timer 14 in order to achieve a game score.

The base 12 comprises upper and lower housing sections 24 and 26, respectively, which cooperate to provide a housing for containing the timer 14 and the ejection mechanism 22 and to provide a mounting structure for supporting the retrieving mechanism 20 and the support assembly 18. The upper and lower housing sections 24 and 26, respectively, include upper and lower walls 27 and 28, respectively, and they cooperate to define a first slot 29 of elongated configuration and a second slot 30 of reduced length in the side wall of the base 12. A substantially circular support assembly opening 32 is formed in the upper wall 27 of the upper housing section 24, and an ejection slot 34 is also formed in the upper wall 27 adjacent the opening 32. A substantially circular retrieving mechanism opening 36 is also formed in the upper wall 27, and a retrieving mechanism actuator opening 38 is formed in a section of the upper housing section 24 which is slightly recessed below the upper wall 27.

The timer 14 is illustrated most clearly in FIGS. 6 through 9, and it comprises a timer housing 40 having an open peripheral notch 41 therein, the housing 40 including upper and lower housing sections 42 and 44, respectively, and a partition 46 which segregates the upper and lower housing sections 42 and 44, respectively. The timer 14 further comprises a winding mechanism generally indicated at 48 which is mounted in the lower housing section 44, a decay mechanism generally indicated at 50 which is mounted n the upper housing section 42, a coupling gear 52, and a shutoff lever 54. The winding mechanism 48 is operative between the wound and unwound positions thereof illustrated in FIGS. 9 and 8, respectively, for driving the decay mechanism 50 and the transmission gear 52. The decay mechanism 50 is operative for retarding the rate at which the winding mechanism 48 is advanced to the unwound position thereof, and the transmission gear 52 is operative for communicating rotation from the timer 14 to the support assembly 18. The shutoff lever 54 is operative for arresting the advancement of the winding mechanism 48 toward the unwound position thereof so that the winding mechanism 48 can be temporarily retained in a fully wound and various partially unwound positions.

The winding mechanism 48 comprises a winding arm 56 which is mounted on a shaft 58, a winding spring 60, and a fan gear 62. The winding arm 56 includes an outer end portion which travels in the slot 29 in the base 12 as the winding arm 56 is pivoted about the axis of the shaft 58, and a lug 63 (see FIG. 6) is formed on the upper side of the winding arm 56. The fan gear 62 is integrally formed with the winding arm 56, and it is positioned so that it passes through an open gear housing 64 on the partition 46 as the winding arm 56 travels in the slot 29. Lugs 66 and 68 are formed on the underside of the winding arm 56 and on the partition 46, respectively, and the spring 60 extends between the lugs 66 and 68 for biasing the winding arm 56 toward the unwound position thereof illustrated in FIG. 8.

Figure 7:
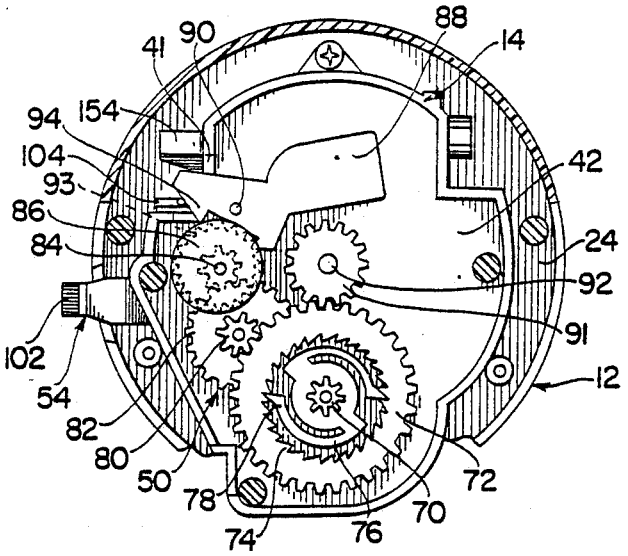
FIG. 7 is a sectional view taken along line 7—7 in FIG. 4.
Figure 8:
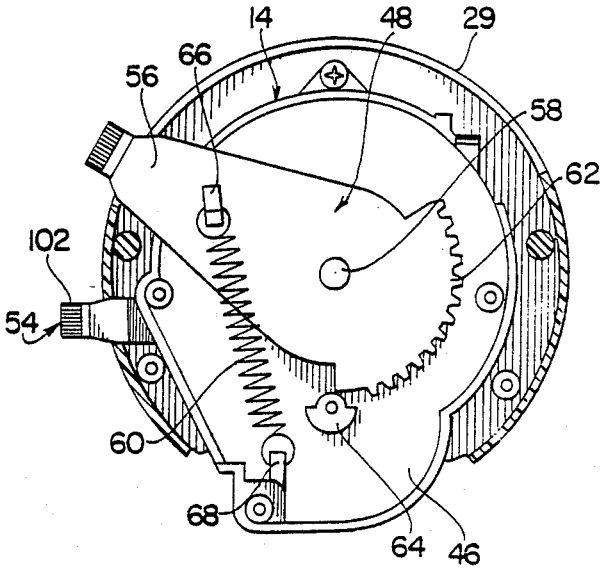
FIG. 8 is a sectional view taken along line 8—8 in FIG. 4.

The decay mechanism 50 is illustrated in FIG. 7, and it includes a reduced main drive gear 70 and an enlarged intermediate drive gear 72. The reduced main drive gear 70 is mounted in the open gear housing 64 so that it communicates with the fan gear 62 as the fan gear 62 passes through the gear housing 64. The intermediate drive gear 72 is formed with a substantially circular central recessed area therein, and a plurality of inner ratchet teeth 74 are formed in the intermediate drive gear 72 around the periphery of the central recessed area therein. Mounted on a common shaft with the main drive gear 70 is a ratcheting 76 including a pair of resilient ratchet arms 78 which are operative for selectively providing communication between the main drive gear 70 and the intermediate drive gear 72 so that the intermediate drive gear 72 can be rotated by the main drive gear 70 and the ratchet arms 78 in the direction indicated but not in the reverse direction. Specifically, the ratchet ring 76 is adapted so that when the main drive gear 70 is rotated in the opposite direction to that indicated, the ratchet arms 78 pass over the ratchet teeth 74 to permit relative rotation between the main drive gear 70 and the intermediate drive gear 72. The decay mechanism 50 further comprises a reduced transmission gear 80 which intermeshes with the intermediate drive gear 72, an enlarged transmission gear 82 which is integrally formed with the reduced transmission gear 80, and an escapement wheel gear 84 which intermeshes with the enlarged transmission gear 82. The decay mechanism 50 further comprises an escapement wheel 86 which is integrally formed with the escapement wheel gear 84, an escapement arm 88 which is pivotably mounted on a shaft 90 and a coupling drive gear 91 which is mounted on a shaft 92 so that it intermeshes with the intermediate drive gear 82. The escapement wheel 86 is formed with a plurality of pointed or V-shaped teeth 93 thereon, and the escapement arm 88 includes a pair of jaws 94 both of which are engageable with the teeth 93 and one of which projects outwardly into the notch 41. Accordingly, as the escapement wheel 86 is rotated, the escapement arm 88 oscillates back and forth as the jaws 94 pass from tooth 93 to tooth 93 in order to produce a ticking sound from the timer 14, and also in order to retard the decay of the timer 14 so that the winding mechanism 48 is advanced toward the unwound position thereof at a controlled rate.

The coupling gear 52 is mounted on the shaft 92 on the upper side of the upper housing section 42 so that it rotates with the coupling drive gear 91. The coupling gear 52 is formed with an upwardly facing multitooth ring thereon which is adapted to be received in intermeshing engagement with a corresponding gear in the support assembly 18 as will hereinafter be more fully set forth. The coupling gear 52 is mounted in an upwardly extending tubular sleeve 100 which is integrally formed with the upper wall of the upper housing section 42, and the timer 14 is assembled in the base 12 so that the sleeve 100 is received in the opening 32 in the upper housing section 24 and so that the multitoothing on the coupling gear 52 faces upwardly.

The shutoff lever 54 is pivotably mounted on the upper wall of the upper housing section 42, and it includes a control member 102 which travels in the slot 30 in the base 12 and a stop member 104 which is positioned in the notch 41 in the timer housing 40. Specifically, the stop member 104 is positioned so that it is receivable in interfering engagement with the escapement arm 88 in order to arrest the advancement of the timer 14. The stop lever 54 is pivotably mounted with a screw 106, and a coil spring 108 is received on the screw 166 for biasing the stop lever 54 toward the upper wall of the upper housing section 42 in order to retain the stop lever 54 in a set position until it is manually repositioned.

Figure 9:
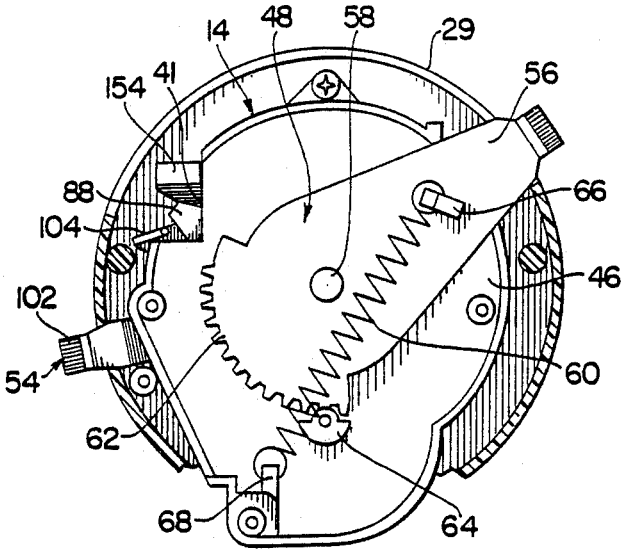
FIG. 9 is a similar sectional view with the timer in an actuated position.

Accordingly, for use and operation of the timer 14, the winding arm 56 is moved to the wound position thereof illustrated in FIG. 9 against the force of the drive spring 60. As the winding arm 56 is moved toward the wound position thereof, the ratchet wheel 76 is rotated in the recess in the intermediate drive gear 72 and the ratchet arms 78 pass over the ratchet teeth 74 so that the intermediate drive gear 72 remains stationary. In order to retain the timer 14 in a fully or partially wound position, the stop lever 54 can be moved to the off position thereof wherein the stop member 104 engages the escapement arm 88 so that oscillation of the escapement arm 88 is prevented. This also prevents the winding mechanism 48 from advancing to the unwound position thereof. However, when the stop lever 54 is moved to the on position thereof wherein it is disengaged from the escapement arm 88, the winding arm 56 is advanced toward the unwound position thereof, and the coupling gear 52 is rotated in the sleeve 100 by the coupling drive gear 96. when the winding arm 56 is advanced to a position wherein the fan gear 62 is disengaged from the main drive gear 70, the winding arm 56 is rapidly advanced to a position wherein it engages the end of the slot 29. In this connection, the slot 29 is preferably formed so that the winding arm 56 can travel a sufficient distance after the fan gear 62 is disengaged from the main drive gear 70 to gain sufficient momentum and speed to effectively operate the ejection mechanism 22 as will hereinafter be set forth.

The game elements 16 are preferably formed in the configuration of small insects or bugs, although they include upwardly extending shafts 100 having spherical balls 112 on the upper ends thereof to enable the game elements 16 to be releasably suspended from the supporting assembly 18.

The support assembly 18 is preferably formed in the configuration of an imaginary or fanciful tree, and it comprises a pedestal portion 114, an upper support portion 116, and a coupling gear 118. The pedestal portion 114 includes an enlarged circular base portion 120 and a shaft 122 which extends downwardly from the base portion 120, and the coupling gear 118 is mounted on the shaft 122 so that it faces downwardly from the lower end thereof. The shaft 122 and the coupling gear 118 are adapted to be loosely received in the sleeve 100 so that the coupling gear 118 is receivable in intermeshing engagement with the coupling gear 52 to communicate rotation from the timer 14 to the support assembly 18. The base portion 120 is positioned so that when the coupling gears 118 and 52 are received in intermeshing engagement, the base portion 120 is positioned adjacent the upper end of the sleeve 100 and extends at least partially over the slot 34. The pedestal portion 114 is further formed with an upwardly opening interior cavity 124 adjacent the upper end thereof, and the upper support portion 116 is loosely secured to the upper end of the pedestal portion 114 with a shaft 126. The shaft 126 extends through the support portion 116, and a spherical ball 128 which is received in the cavity 124 is secured to the shaft 126 for loosely retaining the support portion 116 on the upper end of the pedestal portion 114. The support portion 116 is formed in a generally dome-like configuration, and it has a plurality of peripheral slots 129 therein which are adapted to receive the shafts 110 of the game elements 16 in order to suspend the game elements 16 from the support portion 116 with the ball elements 112.

The retrieving mechanism 20 comprises a retrieving member character figure assembly 128 which is received in the opening 36 in the upper housing section 24, a depressible member 130 which is received in the opening 38 in the upper housing section 24, and a connecting lever 132. The character figure assembly 128 is preferably embodied as an amusing character figure, such as a frog, and it includes an upper head portion 134 and a lower jaw portion 136 which is pivotably connected to the upper head portion 134 about an axis 138. The character figure assembly 128 further comprises a lower neck portion which extends downwardly from the upper head portion 134 and includes a pair of outwardly extending pins 140 which are received in tracks 142 so that the character figure assembly 128 can be moved upwardly and downwardly within a predetermined range in the opening 36. The depressible member 130 includes a downwardly extending shaft 144 which is slidably received in a socket 146 in the lower housing section 26, a spring 148 which is received on the shaft 144 for biasing the depressible member to the upwardly extending position illustrated in FIGS. 1, 3 and 5, and a leg 150 which extends outwardly from the depressible member 130 for communicating movement from the depressible member 130 to the connecting lever 132. The connecting lever 132 extends between the leg 150 and the lower end of the character figure assembly 128, and it is pivotably mounted in the base 12 with a pair of pins 152 which extend outwardly from opposite sides of the connecting lever 132. Accordingly, the depressible member 130 is depressible for pivoting the connecting lever 132 to move the character FIG. 128 upwardly. Further, the depressible member 130 is operative for pivoting the lower jaw portion 136 to the closed position thereof. Specifically, by depressing the depressible member sharply downwardly, a sufficient amount of upward momentum can be imparted to the lower jaw portion 136 to cause the lower jaw portion 136 to be pivoted upwardly when the character figure assembly 138 reaches the upper limit of its upward travel. Accordingly, the depressible member 130 is operative for both moving the character figure assembly 128 upwardly and for moving the lower jaw portion 136 to the closed position thereof to enable the character figure assembly 128 to capture the game elements 16 and to retrieve them from the support assembly 18.

Figure 3:
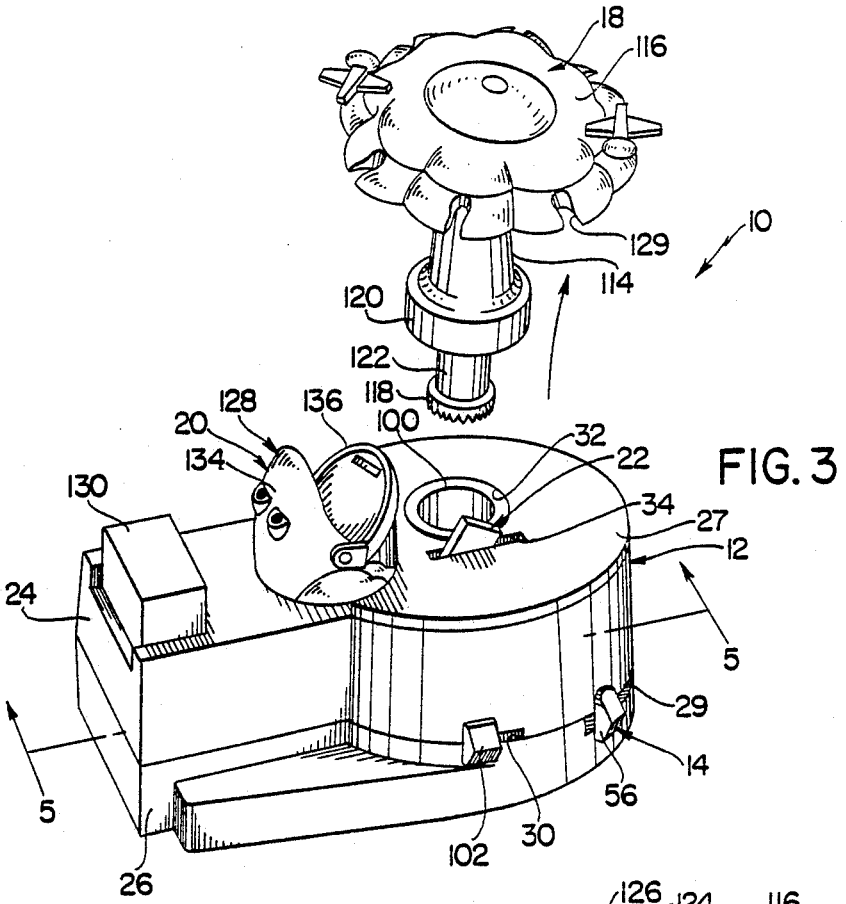
FIG. 3 is a similar view illustrating the operation of the ejection mechanism of the apparatus.
Figure 4:
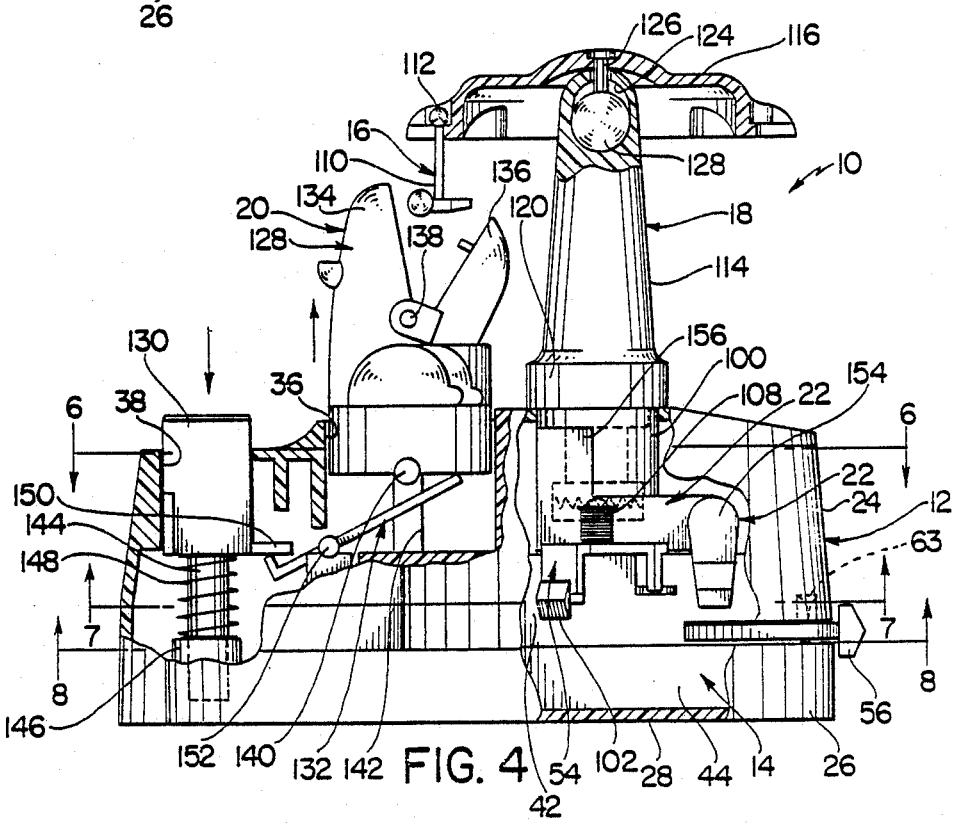
FIG. 4 is a sectional view taken along line 4—4 in FIG. 3.
Figure 5:
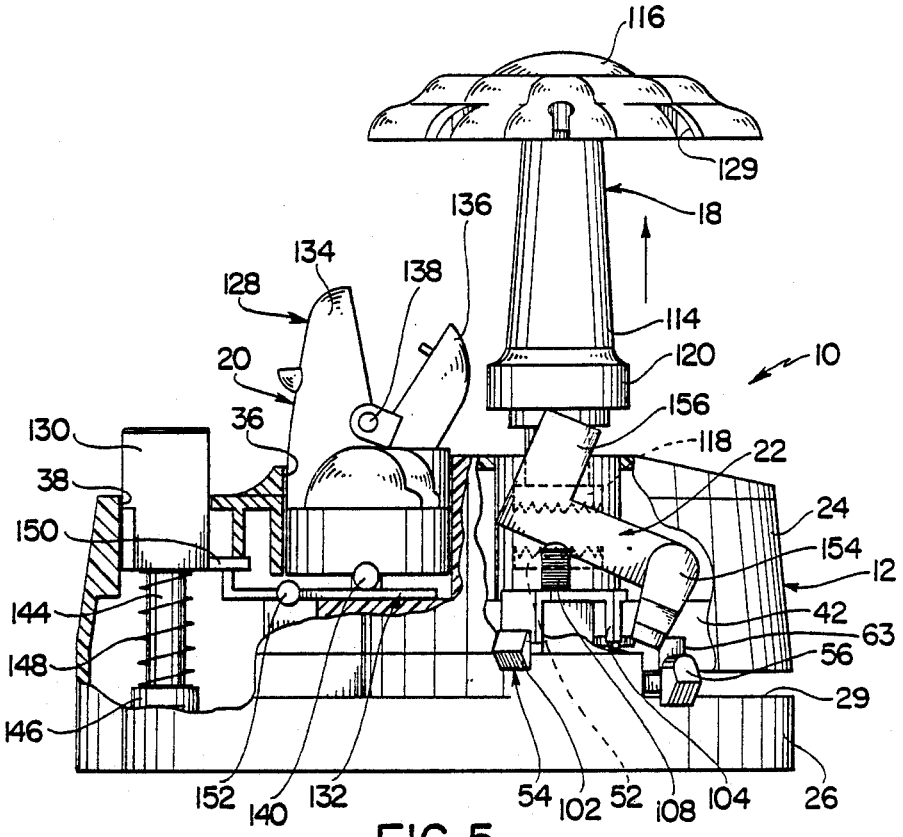
FIG. 5 is a similar sectional view illustrating the operation of the ejection mechanism.
Figure 6:
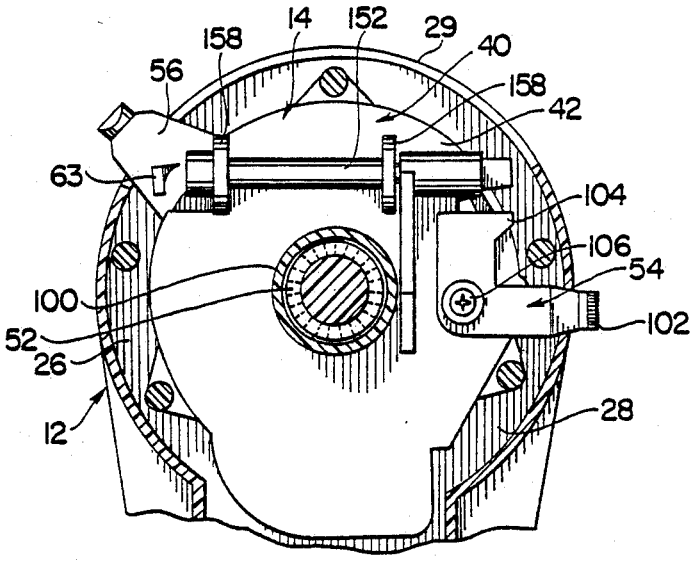
FIG. 6 is a sectional view taken along line 6—6 in FIG. 4.

The ejection mechanism 22 is illustrated most clearly in FIGS. 3 through 6, and it is operative for ejecting the support assembly 18 from the base 12 upon the expiration of a set period of time as determined by the timer 14. The ejection mechanism 22 comprises an integrally formed member including a pivot shaft 152, a downwardly extending leg 154, and an L-shaped arm 156. The pivot shaft 152 is mounted in a pair of mounts 158 which are integrally formed on the upper wall of the upper timer housing section 42, and the leg 154 extends downwardly from the shaft 152 into the notch 41 in the housing 40. The leg 154 is further positioned so that when the winding arm 56 is advanced to the fully unwound position thereof, the lug 63 on the winding arm 56 engages the leg 154 to pivot the shaft 152 in the mounts 158. The arm 156 extends outwardly from the shaft 152 and then upwardly so that it is receivable through the slot 34 in the housing 12 as illustrated in FIGS. 3 and 5. Accordingly, when the lug 63 on the winding arm 56 engages the leg 154 to pivot the pivot shaft 152, the L-shaped arm 156 engages the base portion 120 of the support assembly 18 in order to eject the support assembly 18 from the base 12. In this connection, the slot 29 is preferably dimensioned to enable the winding arm 56 to travel a significant distance therein after the fan gear 62 is disengaged from the drive gear 70. Hence when the lug 63 on the winding arm 156 is propelled into engagement with the leg 154, the lug 63 sharply engages the leg 154 in order to rapidly move the arm 156 upwardly so that it sharply engages the base portion 122 with sufficient force to propel the support assembly 18 upwardly from the base 12.

For use and operation of the apparatus 10, the winding arm 56 is moved to the wound position thereof illustrated in FIG. 9, and the stop lever 54 is moved to the "off" position thereof wherein the stop member 104 engages the escapement arm 88 to prevent the advancement of the timer 14. The support assembly 18 is then assembled on the base 12 so that the coupling gears 118 and 52 are received in intermeshing engagement, and the game elements 16 are assembled in the slots 129 in the support member 116. The stop lever 54 is then moved to the "on" or actuated position thereof so that the support assembly 18 with the game elements 16 thereon is rotated by the timer 14 as the timer 14 is advanced toward the unwound position thereof. Once the timer 14 has been actuated, a game player can operate the depressible member 130 in order to move the character FIG. 128 upwardly for retrieving the game elements 16 from the support assembly 18. In this connection, by sharply depressing the depressible member 130, it is possible to rapidly move the character figure assembly 128 upwardly so that the momentum which is imparted to the lower jaw portion 136 causes the lower jaw portion 136 to be pivoted to a closed position when the character figure assembly 128 reaches its uppermost position. As a result, the character figure assembly 128 is operatable with a simulated snapping action for capturing the game elements 16 in order to effectively retrieve them from the support assembly 18. However, it should be pointed out that by depressing the depressible member 130 too sharply, it is possible to dislodge the game elements 16 from the support assembly 18 without capturing them in the mouth of the character figure assembly 128. Accordingly, the ability of a game player to achieve a game score depends both on the ability of the game player to time the operation of the retrieving mechanism 20 with the positions of the individual game elements 16 and also to effectively depress the depressible member with the appropriate amount of force so that the game elements 16 are retrieved in the mouth of the character FIG. 128 and not merely dislodged. In any event, when the timer 14 reaches a position wherein the fan gear 62 is disengaged from the main drive gear 70, the winding arm 56 is rapidly advanced to the adjacent end of the slot 29 so that the lug 63 engages the leg 154 of the ejection mechanism 22 to eject the support assembly 18 and any of the game elements 16 remaining thereon from the base 12.

It is seen therefore that the instant invention provides an effective and amusing game apparatus which is adapted for use in connection with an interesting and challenging amusement game. In this connection, in order to achieve a game score, a game player must manipulate the retrieving mechanism 20 at the appropriate times and with the appropriate amount of force in order to capture the game elements 16 in the mouth of the character figure assembly 128. As a result, the apparatus 10 requires the application of a significant level of skill and manual dexterity in order to achieve a high game score. Hence, it is seen that the apparatus of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An action toy game apparatus comprising a base, a timer in said base actuatable for a set period of time, a plurality of game elements, game element support means mounted on said base for releasably supporting said game elements in upwardly spaced relation thereto, said game element support means communicating with said timer and rotating when said timer is in an actuated condition for moving said game elements in a substantially circular path which is spaced upwardly from said base, and retrieving means mounted on said base and manually actuatable for individually retrieving said game elements from said support means as said game elements are moved in said substantially circular path, said retrieving means including a depressible member and a character figure, said depressible member being manually depressible for moving said character figure upwardly to retrieve said game elements from said game element support means, said character figure including an upper head portion and a lower jaw portion which cooperate to define a mouth of said character figure, said lower jaw portion being pivotably mounted on said upper head portion for moving said mouth between open and closed positions thereof, said mouth being in the open position thereof when said depressible member is in an undepressed position and being inertially movable to a closed position by depressing said depressible member to retrieve said game elements in the mouth of said character figure.

2. An action toy game apparatus comprising a base, a timer in said base actuatable for a set period of time, a plurality of game elements, game element support means mounted on said base for releasably supporting said game elements in upwardly spaced relation thereto, said support means comprising a pedestal portion mounted on said base so that it extends upwardly therefrom and a substantially circular upper support portion mounted in a substantially horizontal disposition on said pedestal portion in upwardly spaced relation to said base, said upper support portion having a plurality of radially inwardly directed spaced slots therein, means for releasably retaining said game elements in said slots so that they extend downwardly from said upper support portion, said game element support means communicating with said timer and rotating when said timer is in an actuated condition for moving said game elements in a substantially circular path which is spaced upwardly from said base, and retrieving means mounted on said base and manually actuatable for individually retrieving said game elements from said support means as said game elements are moved in said substantially circular path.

3. An action toy game apparatus comprising a base, a timer in said base actuatable for a set period of time, a plurality of game elements, game element support means mounted on said base for releasably supporting said game elements in upwardly spaced relation thereto, said game element support means being ejectable from said base, said game element support means communicating with said timer and rotating when said timer is in an actuated condition for moving said game elements in a substantially circular path which is spaced upwardly from said base, retrieving means mounted on said base and manually actuatable for individually retrieving said game elements from said support means as said game elements are moved in said substantially circular path, and means for ejecting said support means from said base upon the expiration of said set period of time.

* * * * *